US006962412B2

(12) United States Patent
Koike et al.

(10) Patent No.: US 6,962,412 B2
(45) Date of Patent: Nov. 8, 2005

(54) COVER UNIT AND RECOVERY APPARATUS

(75) Inventors: Yasushi Koike, Kanagawa-ken (JP); Kazuhisa Kawakami, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 181 days.

(21) Appl. No.: 10/611,981

(22) Filed: Jul. 3, 2003

(65) Prior Publication Data

US 2004/0004642 A1 Jan. 8, 2004

(30) Foreign Application Priority Data

Jul. 4, 2002 (JP) ..... 2002-195807

(51) Int. Cl.[7] ..... B41J 29/13
(52) U.S. Cl. ..... 347/108; 400/691; 400/694
(58) Field of Search ..... 347/108; 400/691–694; 403/380, 329; 428/75; 348/108

(56) References Cited

U.S. PATENT DOCUMENTS 5,612,111 A * 3/1997 Lin ..... 428/71
6,722,809 B2 * 4/2004 Hamberger et al. ..... 403/329
6,729,585 B2 * 5/2004 Ogden ..... 248/58

FOREIGN PATENT DOCUMENTS

JP 2001246807 A * 9/2001 ..... B41J 29/13

OTHER PUBLICATIONS

U.S. Appl. No. 10/610,585, filed Jul. 2, 2003, Kawakami et al.

* cited by examiner

*Primary Examiner*—Stephen Meier
*Assistant Examiner*—Ly T. Tran
(74) *Attorney, Agent, or Firm*—Fitzpatrick, Cella, Harper & Scinto

(57) ABSTRACT

A cover unit includes a first metal cover having at least one side surface and a second cover made of a material not soluble with the material of the first metal cover. A tongue is formed on the side surface of the first metal cover. The second cover is formed with a brim covering at least one side surface end of the first metal cover and with a hole at a position corresponding to the position of the tongue of the first metal cover.

9 Claims, 7 Drawing Sheets

COVER UNIT AND RECOVERY APPARATUS

BACKGROUND OF THE INVENTION

1. Field of the Invention

This invention relates to a cover unit and a recording apparatus having the cover unit.

2. Description of Related Art

Electric and electronic apparatuses including home electronic products recently come to have similar specifications in respective sales price bands among competitive entities, and industrial designs tend to provide distinguishable property. As elements for distinguishable property, shape of appearance, color, and qualitative feeling found in material are exemplified.

Products having metallic taste industrial designs are increasing their number recently among goods particularly having portability such as cameras and cellar phone devices as well as electric, electronic apparatuses in the field of personal computers. To obtain those metallic taste industrial designs, some parts can be found using, as a material, metal itself, resin with a metallic taste coating, so called metallic resin containing a metal powder, and the like.

In the meantime, recycling and reuse trends in resins of petroleum chemical products, other than metal materials that have been recycled, are rising these days concurrently with raising of environment protection minds. In consideration of only the territory of Japan, enacted are laws relating to processing and cleaning of wastes (Showa 45 law No. 137, generally referred to as "waste processing law"), laws relating to promotion of use of recycled resources (Heisei 3 law No. 48, generally referred to as "recycle law"), laws relating to separate collection about container packages and promotion of re-commercialization, etc. (Heisei 7 law No. 112, generally referred to as "package recycle law"), specific home use apparatus re-commercialization laws (Heisei 10 law No. 97, generally referred to as "home electronics recycle law"), etc., and according to establishments of those legal restrictions, recycling of thermoplastic resin is accelerated among some goods for large size home electronics goods and automobiles.

Reduction of integral formation among parts made of materials having property not mutually soluble to each other and reduction of the material number itself are targeted in environmental regulations or the like in respective countries, and coating on a resin and printing area size are also exemplified as targets of regulations.

Though there is Germany "Blue Angel" as a representative environmental regulation, "Eco Mark" certifications are given in Japan in respective categories from Japanese Environment Association. "Eco Marks" are set, regarding office apparatus products, for personal computers and photocopiers on November, 1999, and for printers on October, 2001. There are descriptions "checking on suitability with respect to materials" or "satisfying VDI2243," and those are matters requiring compatibility among materials.

The compatibility refers to a mutually compatible state in a case that, e.g., polymers of two or more kinds are mixed. Simple mixture is no more than dispersion of materials and distinguishable from the solubility because of lack of solution.

For example, in a case that a cover as a housing member (appearance member) forming the apparatus housing is considered to be added with, e.g., color and quantitative feeling found in material for a distinguishing purpose, the environment standards and the environment regulations are to be considered though some choices can be thought.

Where the cover is structured of a metal only, the cover tends to become a member with low designing freeness since the shape formed through a metal processing is subject to considerable restrictions, and the cover may be prone to a lowered functioning state. A method of post processing may be used to prevent the functions from becoming inferior, but the costs may be increased, and consequently, users may be disadvantaged with high cost goods.

On the other hand, in a case that the cover is structured of a resin only, the resin is conventionally painted to correspond the needs to obtain a distinguishable industrial design. With such a conventional painting, e.g., metallic quantitative feeling, particularly, coolness of metal when touched, is not expressed with painting, so that the cover may be finished with a mediocre industrial design.

SUMMARY OF THE INVENTION

It is an object of the invention to provide a cover unit and a recording apparatus with a tongue of a first metal cover and a hole of a second cover to render the cover unit easy to attach and detach. The cover unit is made of a double structure with materials not compatible to each other to correspond to environment standards, with a structure that a side surface end of the first metal cover is covered with a brim of the second cover to render unnecessary any post-processing such as edge treatment of the metal cover and render the cost down, and with the metal cover to obtain parts excellent in industrial design.

It is another object of the invention to provide a cover unit and a recording apparatus with a projection covering the end surface of the tongue of a first metal cover to the second cover, thereby rendering unnecessary any postprocessing such as edge treatment of the end surface of the tongue and rendering the cost down.

It is yet another object of the invention to provide a cover unit and a recording apparatus with formation that the projection of the second cover does not cover the whole end surface of the tongue of the metal cover to easily disengage the engagement between the first metal cover and the second cover via the tongue upon inserting a tool from the uncovering place.

It is still another object of the invention to provide a cover unit and a recording apparatus with a brim of the second cover covering a part of an outer periphery of the first metal cover side surface to hide the shape of the side surface end of the metal cover and to render unnecessary any postprocessing for improved finishing on the side surface end and to render the cost down.

It is further another object of the invention to provide a cover unit and a recording apparatus with use of a material suitable for ornaments on the first metal cover to render the parts excellent in industrial design.

It is still further another object of the invention to provide a cover unit and a recording apparatus with a second cover made of a thermoplastic resin to render the shape freely designable and to improve the function.

Further objects of the invention will be apparent by referring to the attached drawings and reading the following detailed description.

DETAILED DESCRIPTION OF THE PREFERRED EMBODIMENTS

Figure 1:
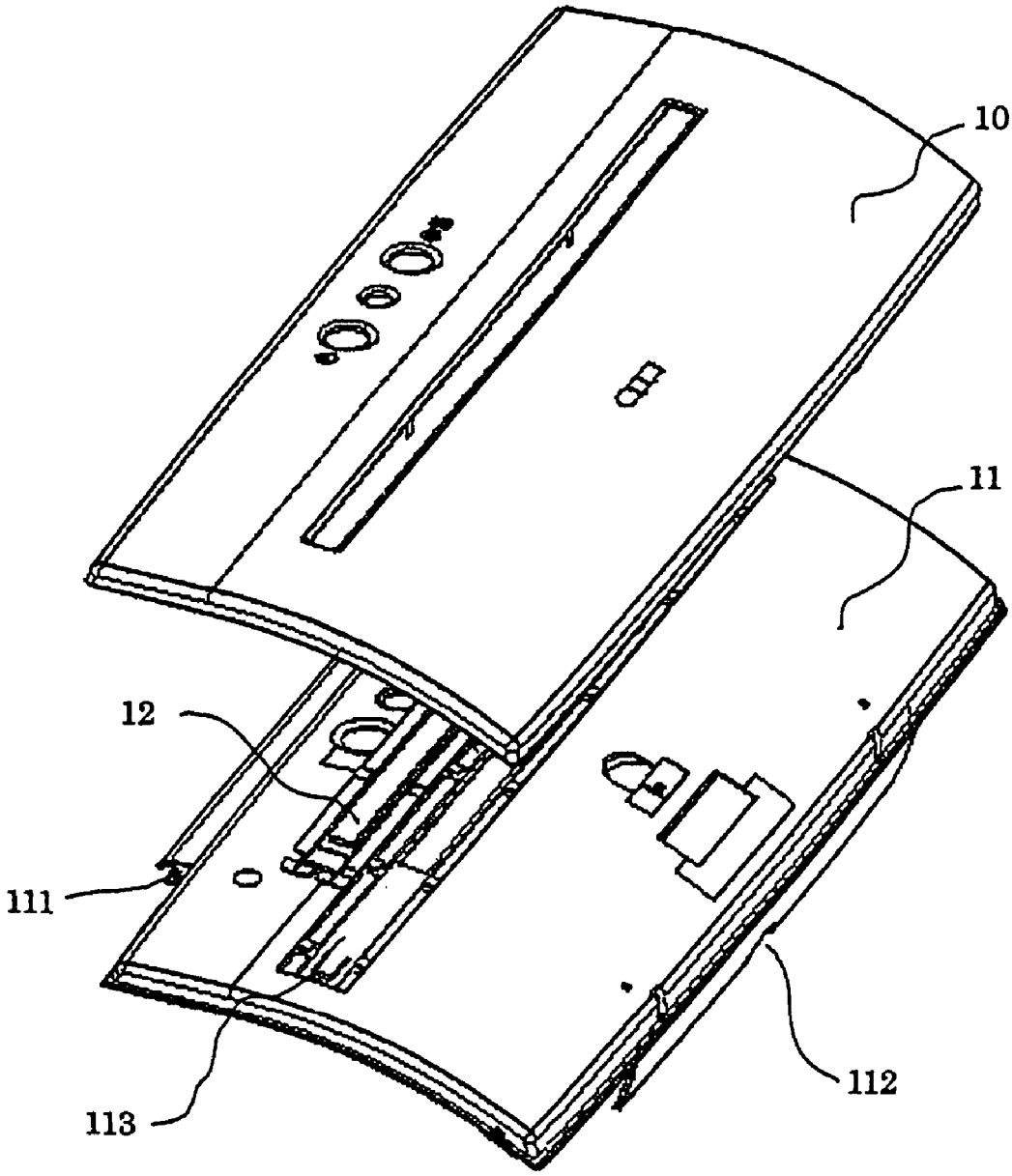
FIG. 1 is an exploded perspective view showing a structure of a cover unit.

Hereinafter, referring to the drawings, preferred embodiments of the invention are described in detail in an exemplifying manner. The size, material, shape, correlative layout of structural parts as set forth in the embodiments below can be modified property according to the structure of the apparatus to which this invention applies and various conditions, and the scope of the invention is not intended to be limited to those as far as any specific described does not exist.

Referring to FIGS. 1 to 7, an embodiment of the invention is described in detail. In this embodiment, the cover unit according to the embodiment of the invention is described as an example when used as an outer housing forming a housing of the recording apparatus, but this invention is not limited to this.

Figure 2:
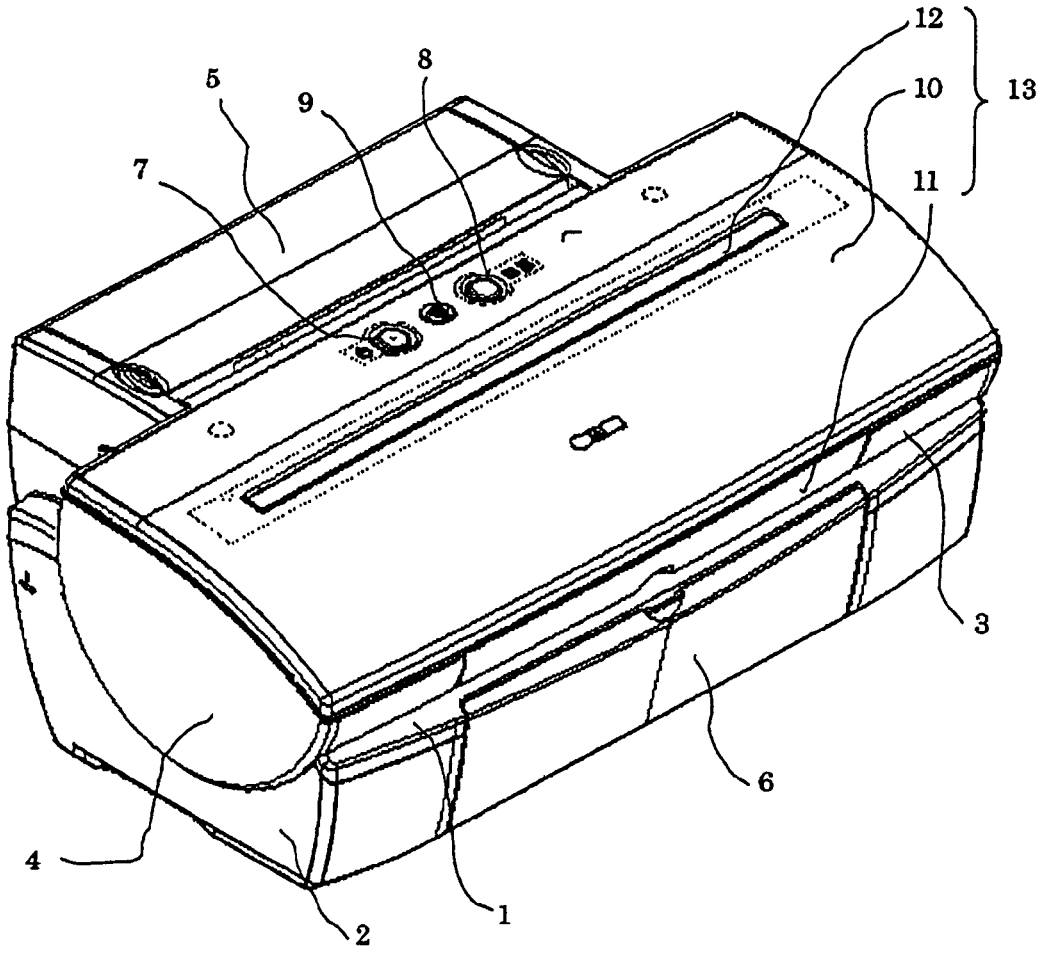
FIG. 2 is a perspective view showing appearance of an inkjet recording apparatus according to an embodiment of the invention.

FIG. 1 is an exploded perspective view showing a structure of the cover unit according to the embodiment of the invention; FIG. 2 is a perspective view showing appearance of an inkjet recording apparatus according to an embodiment of the invention.

First, the appearance structure of the entire recording apparatus is described. In FIG. 2, the recording portion, not shown, is covered with an upper casing 1, a lower casing 2, a right casing 3, and a left casing 4. A feeding tray 5 is supported around an axis as to be open and closed with respect to the upper casing 1. The feeding tray 5 is open during recording to stack the recording sheets as the recording media and is closed during non-recording to prevent dust and foreign objects from entering. The front cover 6 is supported around an axis as to be open and closed with respect to the lower casing 2. The front cover 6 is open during recording to deliver the recording sheets on which recording is made through the opening to the apparatus exterior and is closed to shut the opening during non-recording to prevent dust and foreign objects from entering to the apparatus interior. A delivery tray, not shown, is held at the lower casing 2 for holding and stacking the recording sheets on which recording is made, and can be pulled out of the lower casing 2 upon opening the front cover 6.

Numeral 7 is a power key; numeral 8 is a reset key for stopping the recording operation and for resetting errors on the recording apparatus. Numeral 9 is an LED lens for lighting and blinking multiple colors according to the circumstances, thereby rendering notice of the apparatus status to the users.

Numeral 13 is a cover unit as an outer housing member forming the housing of the recording apparatus and is constituted of a metal cover 10 as a first cover, a resin cover 11 as a second cover of a material having no compatibility to the metal cover 10 as the first cover, and a window 12. The cover unit 13 is supported around an axis as to be open and closed with respect to the upper casing 1. Upon opening the cover unit 13 covering the opening of the upper casing 1, ink replacement of the recording head as a recording means and repairing processing during paper jamming of the recording sheets can be done. The window 12 allows to see a part of the apparatus interior.

Although the internal structure of the recording apparatus is not illustrated in detail, the recording sheets set on the feeding tray 5 are separately fed one by one, and after recording is made on the respective recording sheets by the recording means, the recording sheets on which recording is made are delivered and stacked on the delivery tray.

Now, the structure of the recording means is described briefly. The recording head as a recording means is for recording ink images on the recording sheet. As a recording means for this apparatus, an inkjet recording method in which ink is discharged out of the recording head to make recording is used. That is, the recording head includes fine fluid discharging outlets (orifices), a fluid route, an energy operation portion formed at a portion of the fluid route, and an energy generating means for generating the fluid droplet forming energy for operating the fluid located at the operation position.

As such an energy generating means for generating the energy, exemplified are a recording method using an electro mechanical converter such as piezo device or the like, a recording method using an energy generating means for making heat by radiation of electromagnetic wave such as a laser or the like and discharging the droplets with operation of the generated heat, and a recording method using an energy generating means for heating the fluid with an electro-thermal converter such as a heating device having a thermal resister and discharging the fluid.

The recording head used for inkjet recording method discharging the fluid with thermal energy, inter alia, can make recording with high definition because the fluid outlet (orifices) for forming droplets to be discharged by discharging droplets for recording can be arranged in a high density. The recording head using the electro-thermal converter as the energy generating means, inter alia, is easily made compact and is advantageous because the head can be mounted with a high density and be produced with less costs.

In this embodiment, as a discharge structure for ink, it is structured to make recording by energizing the electro-thermal converter in response to a recording signal and by discharging ink through the orifices upon growth and contraction of bubbles generated in the ink in utilizing the film boiling generated in the ink from the thermal energy.

Next, a detailed structure of the cover unit according to the embodiment is described in reference to FIG. 1, FIG. 3 to FIG. 7.

FIG. 1 is an exploded perspective view showing the structure of the cover unit. The metal cover 10 as the first cover has, on a top surface, holes for the power key 7, the reset key 8, and the LED lens 9, and a hole for the window 12. A power mark and a reset mark are impressed with respective recesses adjacently to a left side of the hole for the power key and adjacently to a right side of the hole for the reset key. The metal cover 10 has side surfaces at all four surfaces on front side, rear side, right side, and left side, and plural tongues for securing to the resin cover 11 are provided at all of the four surfaces. Plural tongues for securing are provided at the hole for the window 12. The resin cover 11 as a second cover made of a material having no solubility to the material of the metal cover 10 is formed with a bearing 111 capable of supporting around an axis to the upper casing 1, a touching portion 112 becoming a touch point when the cover unit is open and closed, and a window securing portion 113 for securing the window 12. The window 12 is secured to the resin cover 11. Securing holes for securing the tongues on the metal cover 10 are formed in the resin cover 11 at a front side surface, a rear side surface, a right side surface, a left side surface, and a hole for window, respectively. The relation between the tongues on the metal cover 10 and the securing holes in the resin cover 11 for securing the tongues is described as follows, in exemplifying the rear side surface and the front side surface. A description of other side surfaces is omitted here, since other side surfaces are structured in substantially the same way.

Figure 3:
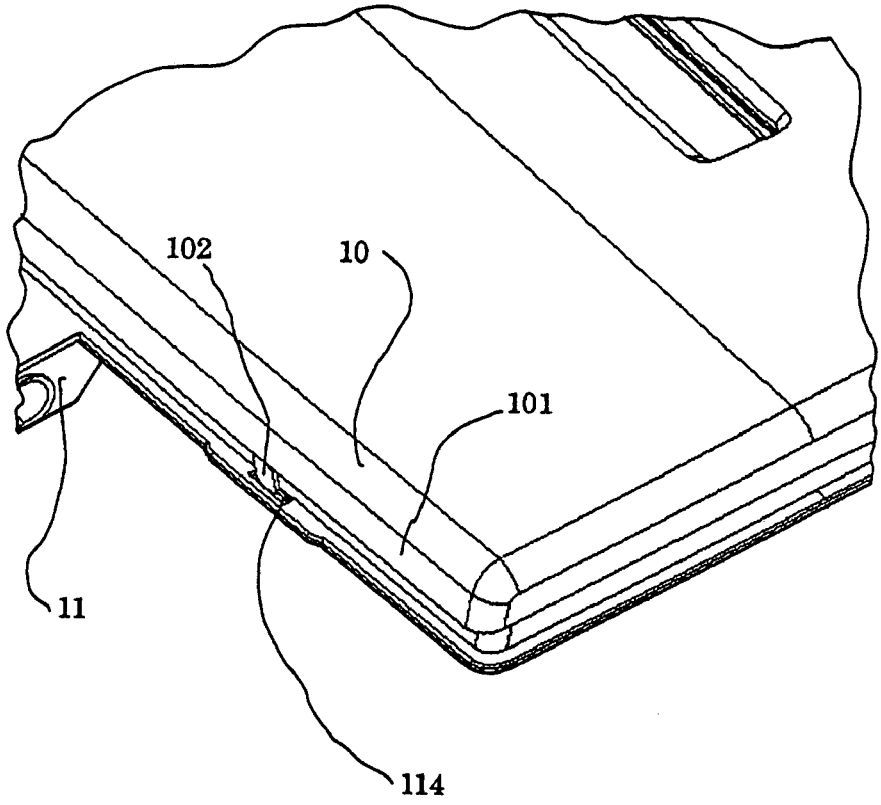
FIG. 3 is a detailed exploded perspective view showing a tongue on a side surface on a rear side.

FIG. 3 is a detailed exploded perspective view showing a tongue on a side surface on a rear side. A rear side tongue 102 is formed on the side surface on a rear side of the metal cover 10. A rear side tongue securing hole 114 is formed at positions corresponding to the rear side tongue 102.

Figure 4:
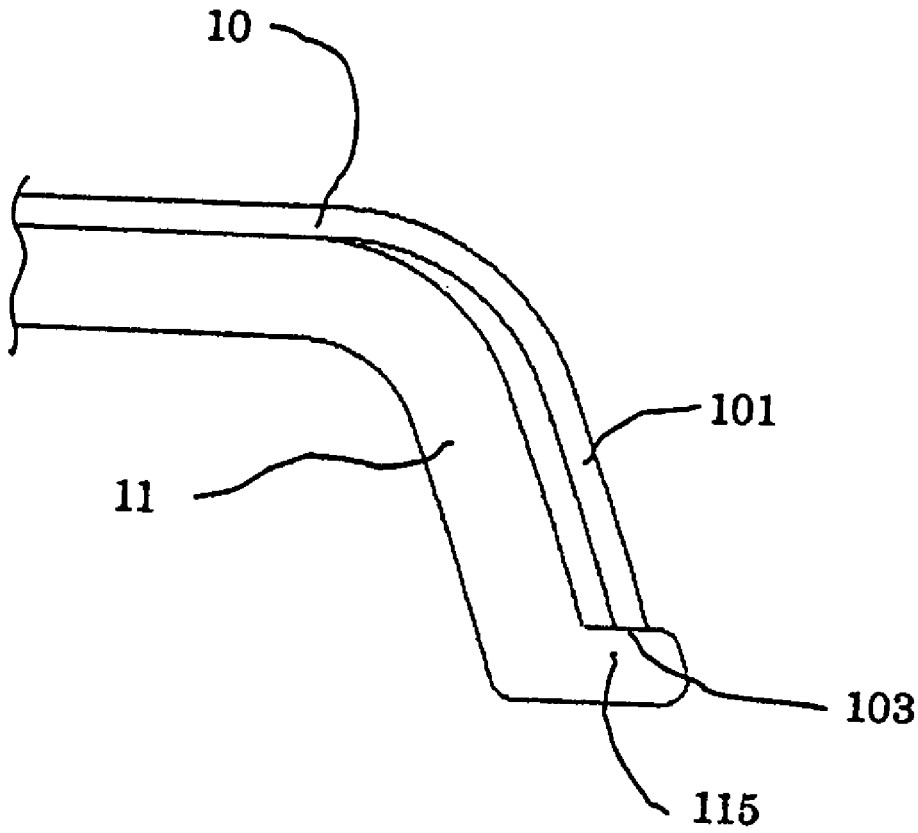
FIG. 4 is a cross section showing a rear brim.

FIG. 4 is a cross section showing a rear brim of the resin cover. The rear brim 115 of the resin cover 11 covers a rear end 103 of the side surface on the rear side of the metal cover 10, and is projecting from the outer peripheral surface of the side surface 101 on the rear side. With this structure, postprocessing on the edge treatment or the like for the side surface end of the metal cover becomes unnecessary, and costs may be reduced.

Figure 5:
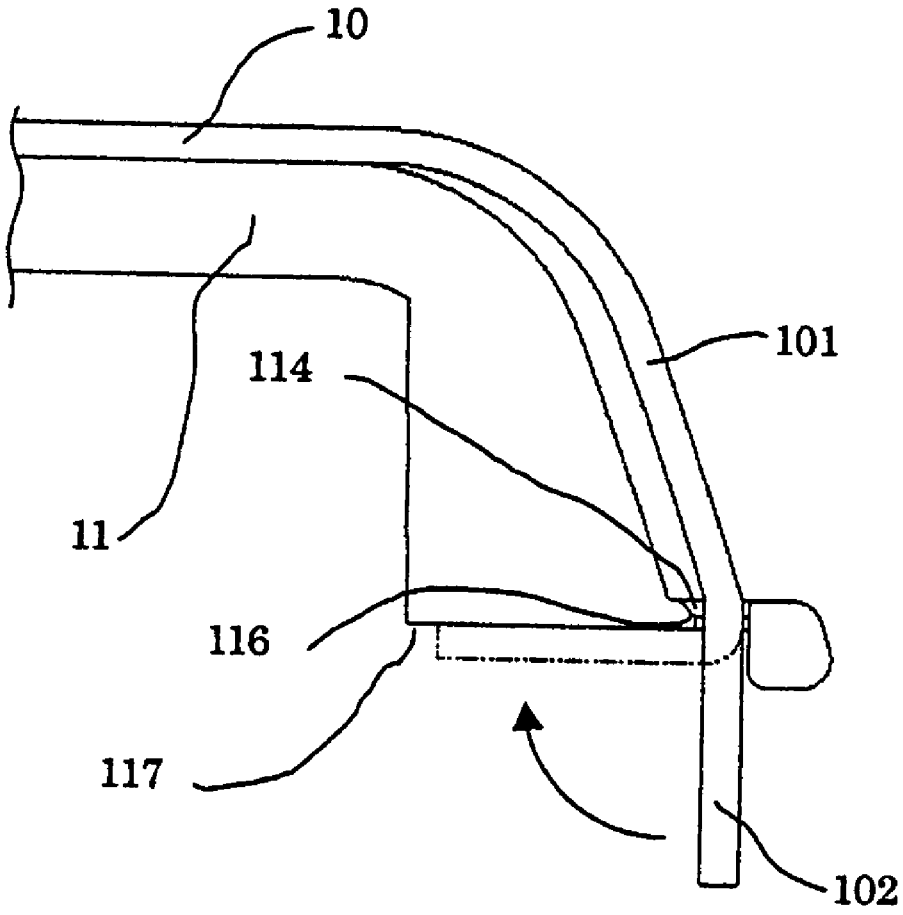
FIG. 5 is a cross section showing a securing portion of a rear tongue.

FIG. 5 is a cross section showing a securing portion of a rear tongue. The metal cover 10 is secured to the resin cover 11 by folding the rear tongue 102 formed on the rear side surface 101 of the metal cover 10 in a clockwise direction as shown with an arrow in FIG. 5 until hitting a folding surface for the rear tongue of the resin cover 11 after the rear tongue 102 is inserted into the rear tongue securing hole 114 of the resin cover 11. A chamfered portion 116 is formed at the rear side tongue securing hole 114 so that the rear tongue 102 can be assembled smoothly to the rear tongue securing hole 114 of the resin cover 11.

Figure 6:
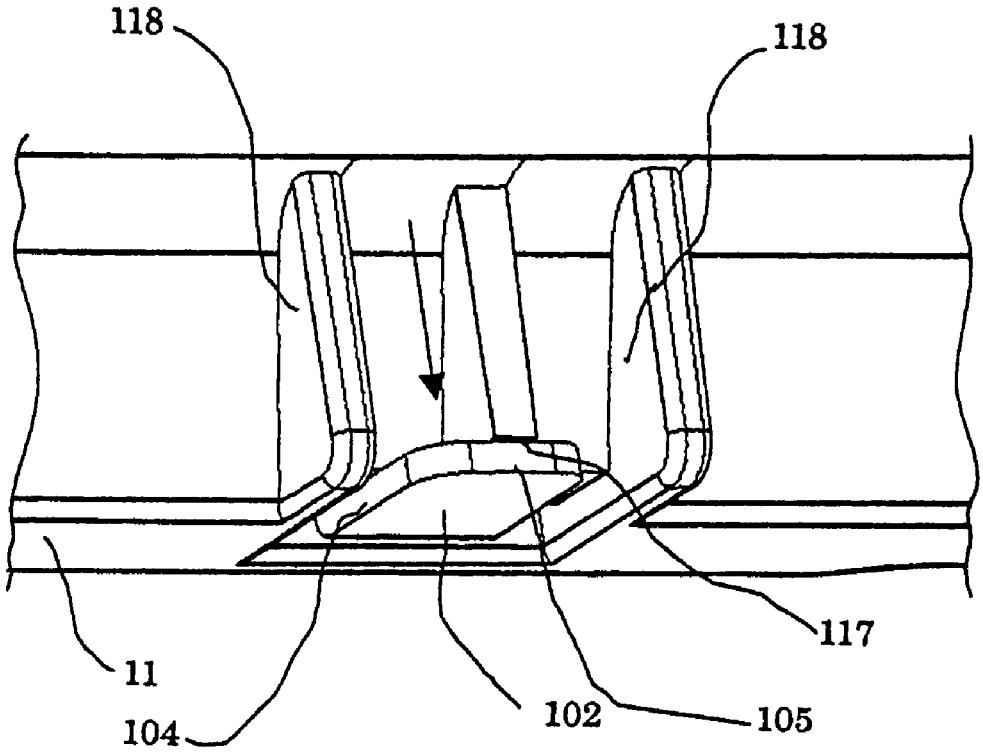
FIG. 6 is a perspective view showing the securing portion of the rear tongue when seen from the back surface.

FIG. 6 is a perspective view showing the securing portion of the rear tongue when seen from the back surface. A rear projection 118 is formed as to cover both of the tongue side end surfaces 104 of the rear tongue 102 on both sides of the rear tongue securing hole 114 of the resin cover 11. No projection as described above is formed at a position covering the tongue front end surface 105 of the rear tongue 102. Therefore, the engagement between the metal cover 10 and the resin cover 11 can be easily disengaged by raising the folded rear tongue 102 in a direction of the arrow in FIG. 6 upon inserting a tool such as a flat tip screwdriver from a direction of the tongue front end that uncovered with the projection, thereby improving disassembling property. A rear tongue folded surface 117 is protruded outwardly from the tongue front end surface 105 of the rear tongue 102 (see, FIG. 5). With this structure, postprocessing such as edge treatments on the end surface of the tongue 102 becomes unnecessary, and the costs can be reduced.

Figure 7:
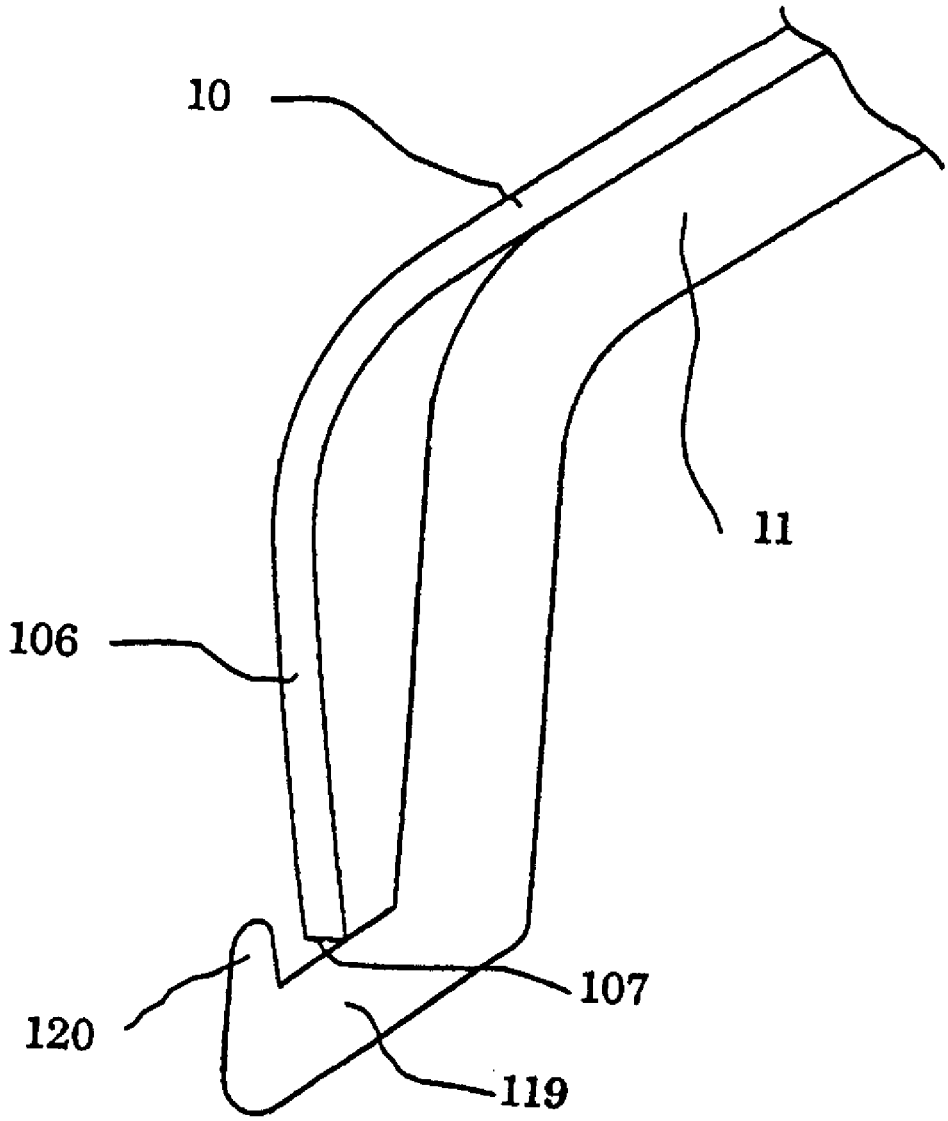
FIG. 7 is a cross section showing a front brim.

FIG. 7 is a cross section showing a front brim of the resin cover. The front brim of the resin cover 11 is constituted of a front brim plain portion 119 arranged at a position facing to the front end 107 of the front side surface 106 of the metal cover 10, and a front brim upright portion 120 formed at a position facing to the front side surface 106. The front end 107 of the front side surface 106 of the metal cover 10 and a part of the front side surface are covered by the front brims 119, 120. Because the front brim of the resin cover 11 is covered though the front brim is in an inclined shape in which the basic appearance goes down as closer to the left side in FIG. 7 whereas the front end 107 of the metal cover 10 is substantially horizontal, the user does not see the front end 107, so that the front end 107 is no problem as keeping the horizontal position, and so that the end surface shape does not affect the appeared industrial design.

As described above, with the embodiment, the tongue of the metal cover 10 and the hole of the resin cover 11 allow easily the cover unit structured with a double structure made of materials not soluble to each other to be secured and separated, so that the embodiment can respond to the environment standards. Moreover, by covering the side surface end of the metal cover 10 with the brim of the resin cover 11, postprocessing such as edge treatments on the side surface end of the metal cover 10 becomes unnecessary, thereby reducing the costs and furthermore producing parts excellent in the industrial design using the metal cover 10.

The resin cover 11 is formed with the projection 118 covering both end surfaces 104 of the tongue 102 of the metal cover 10, so that postprocessing such as edge treatments on the end surface of the metal cover 10 becomes unnecessary, thereby reducing the costs.

The projection 108 of the resin cover 11 does not cover the end surface 105 of the tongue 102 of the metal cover 10, so that the engagement between the metal cover 10 and the resin cover 11 via the tongue 102 is easily disengaged upon insertion of a tool through the uncovered portion.

Since a portion (upright portion 120) covering a part of the side surface outer periphery of the metal cover 10 is formed at the brim of the resin cover 11, the side surface end shape of the metal cover 10 is hidden, so that postprocessing for improving finishing of the side surface end becomes unnecessary, and so that the costs are reduced.

Moreover, by use of a material suitable for ornaments to form the metal cover 10, parts can be obtained with excellent industrial design.

Where the resin cover 10 is made of a thermoplastic resin, the shape of the cover 10 can be freely designed, thereby improving the functions.

OTHER EMBODIMENTS

Although in the embodiments described above, the structure that the metal cover is fastened to the resin cover by folding the tongue on the side surface of the metal cover, is exemplified, this invention is not limited to this. For example, a folded projection may be formed at a free end of the tongue to render the folded projection of the tongue engage with a hole formed in the resin cover.

The cover can be of a good industrial design in appearance where the surface of the metal cover is printed or is with industrial designs such as hair line finishing.

Although in the above embodiments a case that the cover unit is used as a cover serving as the housing member forming the apparatus housing is exemplified, this invention is not limited to this. This cover unit is applicable to other housing members or covers and to not a part but the entire portion thereof.

In the above embodiments the metal cover having the four side surfaces is exemplified, and the structure in which the plural tongues are formed on each of the four side surfaces and in which the holes are formed at the positions of the resin cover corresponding to the tongues, is exemplified, but the numbers of the side surfaces, the tongues, and the holes are not limited to the above numbers and can be set according to the necessity.

In the embodiments described above, the number and the kind of the recording heads are not exemplified specifically, but this invention is applicable to, notwithstanding of the number and the kind of the recording heads, such as an inkjet recording apparatus using a single recording head, an inkjet recording apparatus for color recording using a plurality of recording heads making recording with inks in different colors, and an inkjet recording apparatus for grayscale recording using a plurality of recording heads recording with inks having different density of the same color, and the advantages described above can be achieved.

As a recording means (recording head), this invention is applicable to any structure of the recording means and ink tank, such as a cartridge type in which the recording head and the ink tank are formed in a united body, and a structure in which the recording head and the ink tank are formed as separated bodies which are coupled with an ink supplying tube, in substantially the same way, and substantially the same advantages can be obtained.

It is to be noted that in a case that this invention applies to the inkjet recording apparatus, for example, this invention is applicable to an apparatus using a recording means using an electromechanical converter or the like such as a piezo device, and an excellent advantage can be found in, inter alia, an inkjet recording apparatus using the recording means in which ink is discharged by utilizing the thermal energy. With this method, recording can be performed with higher density and higher definition.

Furthermore, this invention is effectively applicable to a recording head of a full line type having a length corresponding to the maximum width of the recording media that the recording apparatus can make recording. As such a recording head, exemplified are a structure satisfying that length by a combination of the plural recording heads, and a structure that a single recording head formed as a united body. In addition, this invention is advantageous, even of a serial type as described above, for such as a recording head secured to the apparatus body, a recording head of a replaceable chip type that allows electrical connections to the apparatus body and ink supply from the apparatus body upon mounted on the apparatus body, and a recording head of a cartridge type in which the ink tank is formed in a united body with the recording head itself.

As a feature of the inkjet recording apparatus described above, the apparatus can be, other than used as an image output terminal apparatus for information processing apparatuses such as computers, an inkjet input output apparatus capable of mounting a scanner or the like other than the recording head on the carriage, a photocopier in combination with a reader or the like, and a facsimile machine having a transmitting and receiving function. Furthermore, notwithstanding of such an apparatus for office use, this invention is applicable to other electric, electronic apparatuses including home electric products.

In the embodiments described above, the inkjet recording method is exemplified as a recording method, but this invention is not limited to this. This invention can apply even to any recording method such as thermal transfer recording methods, thermal sensing recording methods, impact recording methods such as a wire dot recording method, and other electrophotographic methods.

What is claimed is:

1. A cover unit comprising:

a first metal cover having at least one side surface; and a second cover made of a polymeric material not soluble with the material of the first metal cover;

wherein a tongue is formed on the side surface of said first metal cover, and wherein said second cover is formed with a brim covering at least one side surface end of said first metal cover and with a hole at a position corresponding to the position of the tongue of said first metal cover.

2. The cover unit according to claim 1, wherein said second cover is formed with a projection covering an end surface of the tongue of said first metal cover.

3. The cover unit according to claim 2, wherein the projection of said second cover does not cover the entire end surface of the tongue of said first metal cover.

4. The cover unit according to claim 1, wherein the brim of said second cover is formed with a portion covering a part of an outer periphery of the side surface of said first metal cover.

5. The cover unit according to claim 1, wherein said first metal cover is made of a material suitable for ornamentation.

6. The cover unit according to claim 1, wherein said second cover is made of a thermoplastic resin.

7. A recording apparatus for recording on a recording medium to be conveyed, comprising:

recording means for recording on a recording medium by discharging ink in response to a signal; and a housing member for forming an apparatus housing, wherein said housing member includes the cover unit as set forth in any of claim 1 to claim 6.

8. The recording apparatus according to claim 7, wherein said recording means includes an electro-thermal converter generating thermal energy for ink discharge.

9. A recording apparatus for recording on a recording medium to be conveyed, comprising:

recording means for recording on a recording medium by discharging ink in response to a signal; and a housing member for forming an apparatus housing, wherein said housing member includes a cover unit comprising:

a first metal cover having at least one side surface; and a second cover made of a polymeric material not soluble with the material of said first metal cover, wherein a tongue is formed on the side surface of said first metal cover, and wherein said second cover is formed with a brim covering at least one side surface end of said first metal cover and with a hole at a position corresponding to the position of the tongue of said first metal cover.

* * * * *

UNITED STATES PATENT AND TRADEMARK OFFICE

CERTIFICATE OF CORRECTION

PATENT NO. : 6,962,412 B2
APPLICATION NO. : 10/611981
DATED : November 8, 2005
INVENTOR(S) : Yasushi Koike et al.

It is certified that error appears in the above-identified patent and that said Letters Patent is hereby corrected as shown below:

ON THE COVER PAGE:

In item "(56) References Cited," under "FOREIGN PATENT DOCUMENTS," "JP 2001246807 A * 9/2001 …….B41J 29/13" should read as follows:

-- JP 2001-246807 A * 9/2001 ……..B41J 29/13 --.

COLUMN 1:

Line 11, "bands" should read -- brands --.

Signed and Sealed this

Twenty-first Day of November, 2006

JON W. DUDAS
*Director of the United States Patent and Trademark Office*